US009802226B2

(12) United States Patent
Ginter

(10) Patent No.: US 9,802,226 B2
(45) Date of Patent: Oct. 31, 2017

(54) TOOL AND METHOD FOR CLEANING A DRILLED HOLE

(75) Inventor: Herbert Ginter, Germaringen (DE)

(73) Assignee: Hilti Aktiengesellschaft, Schaan (LI)

( * ) Notice: Subject to any disclaimer, the term of this patent is extended or adjusted under 35 U.S.C. 154(b) by 1428 days.

(21) Appl. No.: 13/332,632

(22) Filed: Dec. 21, 2011

(65) Prior Publication Data

US 2013/0019896 A1 Jan. 24, 2013

(30) Foreign Application Priority Data

Dec. 22, 2010 (DE) ..... 10 2010 063 859

(51) Int. Cl.

| | |
|---|---|
| ***B08B 9/027*** | (2006.01) |
| ***B08B 1/00*** | (2006.01) |
| ***A46B 9/06*** | (2006.01) |
| ***A46B 13/00*** | (2006.01) |
| ***B08B 9/00*** | (2006.01) |
| ***B28D 7/02*** | (2006.01) |
| *A46B 5/02* | (2006.01) |
| *A46B 15/00* | (2006.01) |

(52) U.S. Cl.

CPC ..... *B08B 1/00* (2013.01); *A46B 9/06* (2013.01); *A46B 13/006* (2013.01); *B08B 9/00* (2013.01); *B28D 7/02* (2013.01); *A46B 5/02* (2013.01); *A46B 15/0002* (2013.01); *A46B 2200/3013* (2013.01)

(58) Field of Classification Search

CPC .... B28D 7/02; B08B 1/00; B08B 9/00; A46B 5/02; A46B 9/06; A46B 13/006; A46B 2200/3013; A46B 15/0002

USPC ..... 134/8; 15/104.05

See application file for complete search history.

(56) References Cited

U.S. PATENT DOCUMENTS

| | | | | |
|---|---|---|---|---|
| 4,699,226 | A | 10/1987 | Mueller et al. | |
| 5,002,139 | A | 3/1991 | Haussmann et al. | 175/293 |
| 8,316,965 | B2 | 11/2012 | Hallundbaek et al. | |
| 2009/0288682 | A1 | 11/2009 | Glogger | |
| 2009/0321103 | A1 | 12/2009 | Griffith | |
| 2013/0019896 | A1* | 1/2013 | Ginter | 134/8 |

FOREIGN PATENT DOCUMENTS

| | | |
|---|---|---|
| CN | 101641489 | 2/2010 |
| DE | 20 13 328 | 7/1971 |
| DE | 2013328 | 7/1971 |
| DE | 24 03 722 A | 8/1974 |

(Continued)

OTHER PUBLICATIONS

Translation of FR 2215285.*

*Primary Examiner* — Alexander Markoff

(74) *Attorney, Agent, or Firm* — Davidson, Davidson & Kappel, LLC

(57) ABSTRACT

A tool (10) for cleaning a drilled hole (12), including a tool shank (14) that, relative to the shank axis (A), has an axial attachment end (16) and an opposite axial cleaning end (18), as well as at least one conveying element (20) for removing drilling dust (22) from the drilled hole (12). The conveying element (20) is attached to the tool shank (14) and arranged in the axial direction like a helix around the tool shank (14). The conveying element (20) is configured as a channel (24) that is open in the direction of the attachment end (16). A method for cleaning a drilled hole by such a tool (10) is also disclosed.

16 Claims, 2 Drawing Sheets

(56) References Cited

FOREIGN PATENT DOCUMENTS

| | | | | |
|---|---|---|---|---|
| DE | 2403722 | | | 8/1974 |
| DE | 35 23 477 | A1 | | 1/1987 |
| DE | 3523477 | | | 1/1987 |
| DE | 39 19 095 | A1 | | 1/1990 |
| DE | 19757424 | | | 6/1999 |
| EP | 0201724 | | | 11/1986 |
| EP | 787550 | A1 | * | 8/1997 |
| EP | 2123369 | | | 11/2009 |
| FR | 2215285 | A | * | 9/1974 |
| JP | 63-318 206 | A | | 12/1988 |
| JP | 63318206 | | | 12/1988 |

* cited by examiner

TOOL AND METHOD FOR CLEANING A DRILLED HOLE

This claims the benefit of German Patent Application DE 10 2010 063 859.5 filed Dec. 22, 2010 and hereby incorporated by reference herein.

The invention relates to a tool as well as to a method for cleaning a hole drilled in materials that are preferably and commonly used in construction.

BACKGROUND

When an add-on part is to be subsequently attached to an existing structure, a hole is often drilled and a fastening element is anchored in this hole. The hole is normally created using a drill. In this process, loose material (drillings and drilling dust) remains in the hole drilled in construction materials such as concrete, natural stone or solid brick, whereby the amount of material depends on the size of the drilled hole as well as on the drilling angle (e.g. vertically downwards, horizontal or vertically upwards), and this takes up about 5% to 25% of the drilled hole volume in the case of holes that are drilled vertically downwards or horizontal.

The drillings and the drilling dust have to be removed before the fastening element can be inserted so that a secure and permanent connection can be established. Especially in the case of chemical fastening systems, but also with mechanical anchors, the load-bearing capacity and durability of the fastening depends to a crucial extent on how thoroughly the drilled hole was cleaned.

Nowadays, drilled holes are generally cleaned in that drillings and the drilling dust are removed from the drilled hole by means of blowing or vacuuming devices. Subsequently, the drilling dust that had been pressed against the wall of the drilled hole during the drilling procedure is mechanically loosened by means of brushes. Finally, this loosened drilling dust then has to be removed from the drilled hole again by the blowing or vacuuming device.

The cleaning of drilled holes is an essential part of the installation procedure of fastening elements, and this pertains to the time spent, to the required tools and equipment, as well as to the quality of the fastening work. Thus, for purposes of the vacuuming procedure, aside from a suitable vacuum cleaner, there is also a need for suction tubes that are adapted to the diameter and depth of the drilled holes, since the drilled dust has to be vacuumed from the bottom of the drilled hole. When the drilled hole is blown out, especially in the case of fairly large drilled holes, pressed air is needed in order to achieve effective cleaning. Moreover, the blown-out drilling dust causes considerable dust pollution and is thus a health concern for the workers doing the job.

German patent application DE 39 19 095 A1 discloses a drilling tool, especially a stone drill, that is supposed to allow the drilling dust to already be removed at the time when the hole is being drilled, in that a helical shank of the drilling tool has brush elements that are arranged in the groove bed of a conventional drilling tool or that themselves form spiral conveying helixes. The outer diameter of the helical shank of a conventional drilling tool, however, is much smaller than the inner diameter of the drilled hole being formed, so that the drillings and drilling dust can trickle radially between the helical shank and the wall of the drilled hole, down to the bottom of the drilled hole. Although the radially protruding brush elements provided make it possible to clean adhering drilling dust off the wall of the drilled hole, they do not completely remove the drilling dust that has been loosened and that has accumulated at the bottom of the drilled hole, since the loose material can fall through the brush down towards the bottom of the drilled hole, especially if the brush rubs against the wall of the drilled hole when the drilling tool makes a rotating motion.

SUMMARY OF THE INVENTION

It is an object of the present invention to provide a tool for cleaning a drilled hole that gets rid of drillings and drilling dust from an already finished drilled hole in a simple and quick cleaning procedure, without requiring extensive equipment and without generating much dust.

The present invention provides a tool for cleaning a drilled hole, with a tool shank that, relative to the shank axis, has an axial attachment end and an opposite axial cleaning end, as well as at least one conveying element for removing drilling dust from the drilled hole, said conveying element being attached to the tool shank and arranged in the axial direction like a helix around the tool shank and being configured as a channel that is open in the direction of the attachment end. Such a helical channel can very simply and efficiently remove drillings and drilling dust from the bottom of the drilled hole, in the manner of a corkscrew (twisted into the drilled hole), in combination with an Archimedean screw (after having been twisted into the drilled hole). According to the invention, the helical channel can be configured to be right-handed or left-handed.

In one embodiment of the tool, the conveying element is configured as a conveyor belt with a continuous, especially dust-impermeable transport surface. This continuous conveyor belt—unlike brush elements—prevents the drilling dust from trickling down towards the bottom of the drilled hole.

Preferably, a lengthwise edge of the conveying element is adjacent to the tool shank and is joined to the tool shank, at least in sections. Since the lengthwise edge is joined to the tool shank with as few interruptions as possible, it is prevented that drilling dust trickles down between the conveying element and the tool shank to the bottom of the drilled hole, which would be undesired. Simple fastening possibilities are, for instance, gluing, clamping, welding or the like.

In particular, the conveying element can have a concave transport surface facing the attachment end. The concave configuration of the especially continuous and dust-impermeable transport surface increases the maximum transport volume of the conveying element. Moreover, when the tool is taken out of the drilled hole, the drillings and drilling dust remain more effectively on the transport surface and do not fall straight back down into the drilled hole.

Furthermore, the conveying element is preferably configured elastically in the radial direction. As a result of this radial-elastic design, the conveyor belt advantageously adapts to the sometimes rough and irregular surface of the wall of the drilled hole. Moreover, then a tool with a conveying element whose outer diameter is slightly larger than the diameter of the drilled hole can be inserted into a hole that has a predefined diameter. As a result, a helical outer edge almost continuously rests against the wall of the drilled hole and prevents drilling dust from trickling down between the conveying element and the wall of the drilled hole.

In one embodiment, the conveying element can have a vertical lip on its radially outer edge. As a result of the lip, the maximum transport volume of the conveying element is further increased. Moreover, this prevents the conveying element from getting caught in the wall of the drilled hole, thereby preventing the entire tool from getting stuck or wedged when a tool with a conveying element is being inserted into or withdrawn from a drilled hole that has a predefined diameter and when the outer diameter of the conveying element is a bit larger than the diameter of the drilled hole. The lip is preferably made of the same material as the conveying element, and it is preferably made by bending the radially outer edge of the conveying element, so that the conveying element and the lip are made of one piece. As an alternative, according to another embodiment, especially if the material of the lip is different from that of the conveying element, the lip can be configured in such a way that—depending on the requirements, that is to say, if the outer diameter of the tool with the conveying element is larger than the diameter of the drilled hole or if the wall of the drilled hole is very uneven—said lip can be joined positively or non-positively to the radially outer edge of the conveying element, for instance, it can be pushed on, glued on or the like.

The lip can be arranged parallel to the guide axis of the tool shank, whereby the outer free edge that corresponds to the radially outer edge of the conveying element when the conveying element and the lip are configured in one piece can preferably be bent slightly in the direction of the tool shank so as to prevent tilting here as well.

In a preferred embodiment, the conveying element and the lip are configured in one piece and, as a unit, they have a concave transport surface facing the attachment end, whereby the radius at the area on the lip side is markedly smaller than the radius on the shank side.

The width of the lip can be selected in such a way that the function of the conveying element, namely, to pick up drillings and drilling dust, is not impaired, whereby the width depends on the selected diameter of the drilled hole and on the outer diameter of the conveying element.

The conveying element as well as the lip can be made of metal, especially spring steel, or of plastic, whereby the conveying element and the lip can also be made of different materials. These materials are especially well-suited since, if they are appropriately selected, they are flexible and elastic on the one hand, and they are sufficiently abrasion-resistant on the other hand. Moreover, these materials are also readily and inexpensively available.

In a preferred embodiment of the tool, at least one brush that extends radially outwards is attached to the tool shank in order to clean the wall of the drilled hole. In fact, the conveying element removes loose material located at the bottom of the drilled hole in a manner that does not generate much dust and does not make use of extensive equipment, while nevertheless offering an improvement when it comes to removing drilling dust that has been pressed against the wall of the drilled hole. For this reason, the conveying element is combined with the brush, which only has a moderate capability to transport drilling dust from the bottom of the drilled hole to the opening surface of the drilled hole, but which is excellent at getting rid of drilling dust and adhering drillings from the wall of the drilled hole. In order to ensure continuous contact of the brush with the wall of the drilled hole, the brush preferably extends radially further towards the outside than the conveying element does, and consequently, when the brush is rotated around the shank axis, it describes an outer diameter that is larger than the outer diameter of the conveying element.

The brush is preferably a strip brush that is arranged helically around the tool shank and that can be formed by a continuous strip of bristles or by several tufts of bristles, whereby the brush tufts are arranged along a helix around the tool shank. This strip-like configuration and helical arrangement of the brush, on the one hand, ensures an excellent cleaning performance on the wall of the drilled hole and, on the other hand, assists the conveying element in conveying drillings and drilling dust from the bottom of the drilled hole in the direction of the surface opening. According to the invention, the helix described by the brush arrangement can be configured to be right-handed or left-handed.

The helical brush can have the same pitch as the helical conveying element.

Especially preferably, starting from the brush, an axial distance to the conveying element in the direction of the attachment end is smaller than in the direction of the cleaning end. As a result, the drilling dust that the brush has loosened from the wall of the drilled hole can be picked up very effectively by the section of the conveying element that is adjacent to the cleaning end. In a few embodiment variants, the brush is even directly adjacent to a surface of the conveying element at the cleaning end, as a result of which the bristles of the brushes are supported by the conveying element when the tool is being inserted into the drilled hole and they are thus pressed more firmly against the wall of the drilled hole, so that the cleaning performance is enhanced.

Furthermore, the brush material has a great influence on the cleaning performance as well as on the wear and tear of the brush, whereby the brush preferably has metal, plastic or natural bristles.

In another embodiment of the tool, the conveying element extends axially closer to the cleaning end of the tool shank than the brush does. As a result, the conveying element can be moved very close to the bottom of the drilled hole and can remove loose drillings located at the bottom of the drilled hole much more effectively than the brush can.

The envisaged objective is also achieved by a method for cleaning a drilled hole by means of a tool as described above, whereby the conveying element of the tool has a given outer diameter and the method comprises the following steps:

a) drilling a hole with a predefined diameter that is smaller than the outer diameter of the conveying element;
b) introducing the tool into the drilled hole, whereby the conveying element is elastically deformed in such a way that its outer diameter corresponds essentially to the diameter of the drilled hole.

Thanks to this method, without requiring extensive equipment and without generating too much dust that would bother users, a drilled hole can be cleaned so thoroughly that no drillings or drilling dust, or only a negligible amount, is left behind in the drilled hole.

BRIEF DESCRIPTION OF THE DRAWINGS

Additional features and advantages can be gleaned from the description below of preferred embodiments, making reference to drawings. The figures show the following.

DETAILED DESCRIPTION

Figure 1:
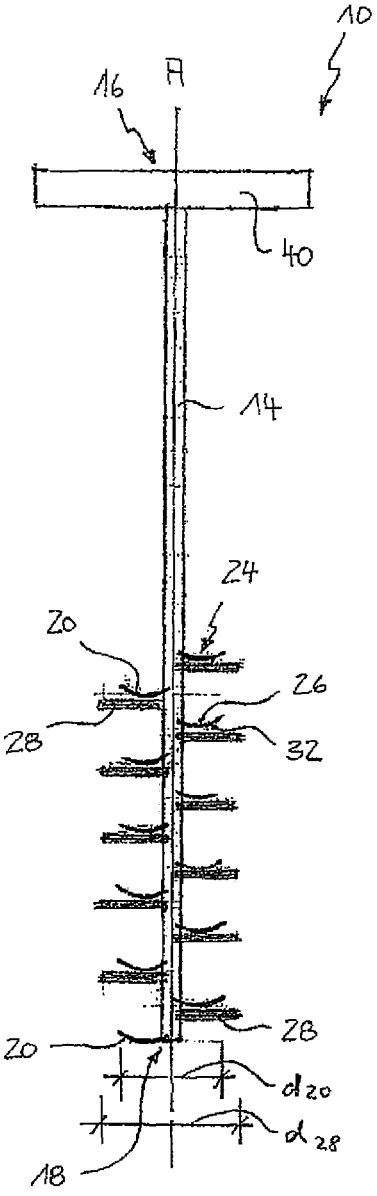
FIG. 1 a schematic longitudinal section through a tool according to the invention according to a first embodiment.

FIG. 1 shows a first embodiment of a tool 10 for cleaning a drilled hole 12 (see FIG. 2), with a tool shank 14 that, relative to a shank axis A, has an axial attachment end 16 and an opposite axial cleaning end 18, as well as at least one conveying element 20 for removing drilling dust 22 (and drillings) from the drilled hole 12, said conveying element 20 being attached to the tool shank 14 and arranged in the axial direction like a helix around the tool shank 14 and being configured as a channel 24 that is open in the direction of the attachment end 16.

The conveying element 20 can be a conveyor belt with a continuous dust-impermeable transport surface 26, whereby a lengthwise edge of the helical conveying element 20 is adjacent to the tool shank 14, and it is preferably in contact with the tool shank 14 or engages with the tool shank 14. Furthermore, the lengthwise edge of the conveying element 20 is joined to the tool shank 14, at least in sections, for example, welded, glued, screwed or held in a helical groove of the tool shank 14 and pressed together with the tool shank 14.

In the embodiment shown, the channel 24 of the conveying element 20 is formed by the concave transport surface 26 that faces the attachment end 16. Due to this concave shaping, the conveying element 20 can pick up more drillings and drilling dust 22 than a flat transport surface 26 can, which is only slanted in a radial direction of the tool shank 14. Of course, the concave conveying element 20 shown can also be slanted in the radial direction. This means that a radially outer end of the conveying element 20 is closer to the attachment end 16 of the tool shank 14 than a radially inner end of the conveying element 20 that is adjacent to the tool shank 14.

Figure 2:
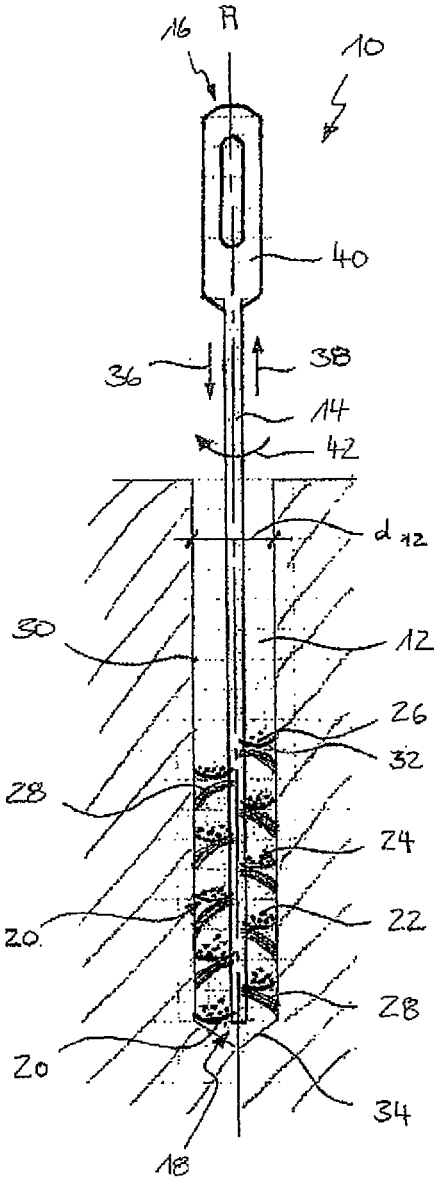
FIG. 2 a schematic longitudinal section through a tool according to the invention according to a second embodiment.

Aside from the conveying element 20, on the tool shank 14, there is additionally at least one brush 28 extending radially towards the outside for cleaning the wall 30 of a drilled hole (see FIG. 2). The brush 28 extends radially further outwards than the conveying element 20, and consequently, during a revolution of the tool 10 around the shank axis A, it describes an outer diameter $d_{28}$ that is larger than an outer diameter $d_{20}$ of the conveying element 20.

Starting from the brush 28, an axial distance to the conveying element 20 in the direction of the attachment end 16 is smaller than in the direction of the cleaning end 18. In the present case, the brush 28 is directly adjacent to a convex surface 32 of the conveying element 20 facing the cleaning end 18.

According to FIG. 1, the brush 28 is a strip brush and, exactly like the conveying element 20, it is arranged like a helix around the tool shank 14. In order to form a strip brush, the brush 28 can be formed by a continuous strip of bristles or, as an alternative, by several tufts of bristles that are attached along a helix on the tool shank 14.

Depending on the material of the wall 30 of the drilled hole as well as on the desired cleaning performance, the brush 28 has metal, plastic or natural bristles. Moreover, the frictional force of the brush 28 against the wall 30 of the drilled hole can also be influenced by the diameter $d_{28}$ of the brush 28.

According to FIG. 1, the conveying element 20 extends axially closer to the cleaning end 18 of the tool shank 14 than the brush 28 does. The reason for this is that, in the area of the bottom 34 of the drilled hole, the pick-up and removal of the accumulated drillings and drilling dust 22 are in the foreground. Brushing off the wall 30 of the drilled hole close to the bottom 34 would not help very much if the drilled hole 12 in this area were still filled with loose material.

FIG. 2 shows the tool 10 according to a second embodiment, whereby the cleaning end 18 of the tool shank 14 have already been inserted axially into the drilled hole 12 (arrow 36), and, in the snapshot shown in FIG. 2, it is being pulled back out of the drilled hole 12 in the opposite axial direction (arrow 38).

The second embodiment of the tool 10 as shown in FIG. 2 is identical to the first embodiment of the tool 10 as shown in FIG. 1, except for an actuation device 40 on the attachment end 16 of the tool shank 14.

Whereas a handle for manually actuating the tool 10 is provided in FIG. 1, the actuation device 40 as shown in FIG. 2 is formed by a defined positive fit contour that, for example, can fit positively into the socket of a power drill or that can fit non-positively into the socket of an electric-powered screwdriver, in order to mechanically actuate the tool 10.

First of all, the drilled hole 12 is made with a prescribed hole diameter $d_{12}$, whereby this hole diameter $d_{12}$ is smaller than the outer diameter $d_{20}$ of the conveying element 20.

Then the tool 10 is inserted axially into the drilled hole 12 in order to clean it, whereby the conveying element 20 is elastically deformed in such a way that its outer diameter $d_{20}$ corresponds essentially to the hole diameter $d_{12}$.

In the concave configuration of the conveying element 20 shown, the deformation during the insertion into the drilled hole 12 essentially only intensifies the concavity of the conveying element 20. The mechanical stress as well as the wear and tear are relatively low, as a result of which the conveying element 20 achieves a satisfactory service life.

The elasticity in the radial direction can be best achieved in that the conveying element 20 is made of metal, especially spring steel or of plastic. Both materials are inexpensively available, easy to shape and, if selected appropriately, they have a high abrasion-resistance.

The tool 10 is first inserted axially into the drilled hole 12 via the actuation device 40 in the direction of the arrow 36 and then pulled back out of the drilled hole 12 in the opposite direction (see arrow 38). At least when the tool 10 is being inserted, but preferably also while it is being pulled out, the tool 10 is rotated around its shank axis A (see arrow 42). The axial pushing or pulling on the tool 10 as well as the torque for the rotation around the shank axis A are either applied manually or mechanically via the actuation device 40.

When the tool 10 is inserted into the drilled hole 12, the conveying element 20 digs into the loose material in the area of the bottom 34 of the drilled hole, in the manner of a corkscrew. When the tool 10 is subsequently pulled out of the drilled hole 12, the drillings and drilling dust 22 are reliably removed from the drilled hole 12, since the radially inner edge of the conveying element 20 is attached continuously to the tool shank 14, and the radially outer edge slides virtually dust-proof along the wall 30 of the drilled hole.

By means of the brush 28, the drilling dust 22 that was pressed against the wall 30 of the drilled hole is loosened while the brush is being inserted as well as while it is being pulled out, then the drilling dust 22 is picked up by the section of the conveying element 20 that is adjacent to the cleaning end 18, and transported out of the drilled hole 12.

Consequently, the drillings and drilling dust 22 can be reliably and thoroughly cleaned out of the drilled hole 12 without requiring extensive equipment and without generating too much dust that would bother users. The tool can be deployed manually or with mechanical assistance. In contrast to the approach of vacuuming or blowing dust out of the drilled hole 12, the proposed cleaning method by means of the tool 10 can be used for dry as well as wet substrates. The cleaning of the drilled hole 12 by means of the tool 10 is thorough and fast, whereby it can even be possible at times to clean drilled holes with slightly differing diameters using one and the same tool 10. The differences in diameter can be compensated for to a certain extent by a lesser or greater deformation of the conveying element 20 as well as of the brush 28, if there is one.

Figure 3:
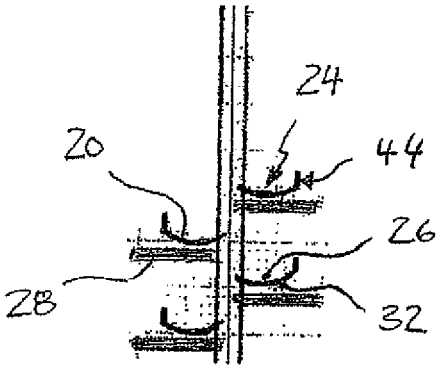
FIG. 3 a schematic section (longitudinal section) of a tool according to the invention according to a third embodiment.
Figure 4:
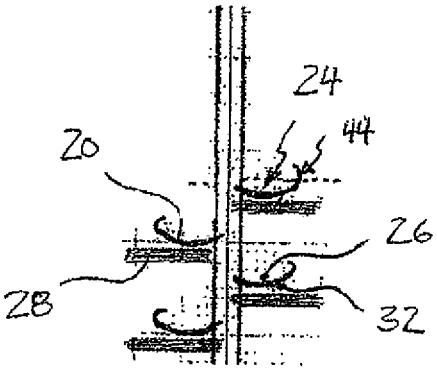
FIG. 4 a schematic section (longitudinal section) of a tool according to the invention according to a fourth embodiment.

FIGS. 3 and 4 show sections of embodiments of the tool according to the invention in which the conveying element 20 has a lip 44, whereby FIG. 3 shows a vertical lip, that is to say, the lip 44 is oriented parallel to the tool shank 14, and FIG. 4 shows a concave lip, that is to say, the lip likewise has a concave configuration, but with a smaller radius in comparison to the conveying element 20.

What is claimed is:

1. A tool for cleaning a drilled hole comprising:

a tool shank having, relative to a shank axis, an axial attachment end and an opposite axial cleaning end; and at least one conveyor for removing drilling dust from the drilled hole, the conveyor being attached to the tool shank and arranged helically in the axial direction around the tool shank, the conveyor configured as a channel open in a direction of the attachment end; and a brush extending radially outwards and attached to the tool shank to clean a wall of the drilled hole, wherein starting from the brush, an axial distance to the conveyor in a direction of the attachment end is smaller than in another direction of the cleaning end.

2. The tool as recited in claim 1 wherein the conveyor is configured as a conveyor belt with a continuous transport surface.

3. The tool as recited in claim 1 wherein the conveyor has a concave transport surface facing the attachment end.

4. The tool as recited in claim 1 wherein the conveyor includes elastic material permitting movement in a radial direction.

5. The tool as recited in claim 1 wherein the conveyor is made of metal or of plastic.

6. The tool as recited in claim 5 wherein the conveyor is made of spring steel.

7. The tool as recited in claim 1 wherein the conveyor has a lengthwise edge adjacent to the tool shank and joined to the tool shank.

8. The tool as recited in claim 1 wherein the brush is a strip brush arranged helically around the tool shank.

9. The tool as recited in claim 1 wherein the brush has several tufts of bristles.

10. The tool as recited in claim 9 wherein the several tufts of bristle are arranged helically around the tool shank.

11. The tool as recited in claim 1 wherein the brush has metal, plastic or natural bristles.

12. The tool as recited in claim 1 wherein the conveyor extends axially closer to the cleaning end of the tool shank than the brush.

13. The tool as recited in claim 1 wherein the conveyor has a lip on a radially outer edge.

14. The tool as recited in claim 13 wherein the conveyor and the lip are made of one piece.

15. A method for drilling a hole and cleaning the drilled hole by the tool as recited in claim 1, the method comprising the following steps:

a) drilling a hole with a predefined diameter smaller than an outer diameter of the conveyor;

b) introducing the tool into the drilled hole, the conveyor being elastically deformed in such a way that the outer diameter changes to correspond to the diameter of the drilled hole.

16. A method for cleaning a drilled hole by the tool as recited in claim 1, the method comprising:

introducing the tool into the drilled hole; and elastically deforming the conveyor in such a way that the outer diameter changes to correspond to the diameter of the drilled hole;

the conveyor having an outer diameter, the drilled hole having a predefined diameter smaller than the outer diameter.

* * * * *